US006688247B1

(12) United States Patent
Danielson

(10) Patent No.: US 6,688,247 B1
(45) Date of Patent: Feb. 10, 2004

(54) QUILT HOLDER FOR FREE-MOTION QUILTING AND PROCESS OF USING

(76) Inventor: Lawerence Henry Danielson, 1824-A Oceanside Blvd., Oceanside, CA (US) 92054

( * ) Notice: Subject to any disclaimer, the term of this patent is extended or adjusted under 35 U.S.C. 154(b) by 3 days.

(21) Appl. No.: 10/245,466

(22) Filed: Sep. 16, 2002

(51) Int. Cl.[7] ..... D05B 11/00; D05B 39/00; D06C 3/08

(52) U.S. Cl. ..... 112/475.08; 112/119; 38/102.91

(58) Field of Search ..... 112/475.08, 117, 112/118, 119, 470.14, 470.16, 103; 38/102, 102.1, 102.21, 102.2, 102.91

(56) References Cited

U.S. PATENT DOCUMENTS

| | | | | | |
|---|---|---|---|---|---|
| 804,501 | A | | 11/1905 | Prather et al. | |
| 923,255 | A | | 6/1909 | Flemister | |
| 1,104,697 | A | | 7/1917 | Morrell | |
| 1,930,076 | A | | 10/1933 | Bently et al. | |
| 1,951,246 | A | * | 3/1934 | Kirkpatrick | 38/102.2 |
| D139,553 | S | | 11/1944 | McCann | |
| 5,129,171 | A | * | 7/1992 | Arbter et al. | 38/102.2 |
| 5,287,640 | A | * | 2/1994 | Morgan | 38/102.2 |
| 5,676,074 | A | * | 10/1997 | Bengal | 112/103 |
| 6,250,239 | B1 | * | 6/2001 | Christ et al. | 112/475.18 |
| 6,390,001 | B1 | * | 5/2002 | Jones | 112/470.15 |

* cited by examiner

*Primary Examiner*—Ismael Izaguirre
(74) *Attorney, Agent, or Firm*—Murphey & Murphey, A.P.C.

(57) ABSTRACT

A device for compactly holding a large quilt during the sewing phase of the quilt-making operation including a three-sided frame having spaced-apart side members, each the side member of terminal length and attached to a single, common cross-member, the frame adapted to enter into close juxtaposition or nesting arrangement with the free arm of a portable sewing machine, a quilt-holding fitting extending from each terminal end of each side member for holding opposed, curled portions of the quilt apart from each other to create a wrinkle-free, planar work area of the quilt therebetween, and a plurality of wheels for moving the frame over a small support surface, such as a card table, to allow machine

20 Claims, 3 Drawing Sheets

QUILT HOLDER FOR FREE-MOTION QUILTING AND PROCESS OF USING

BACKGROUND OF THE INVENTION

1. Field of the Invention

This invention relates to the art of quilting and to the art of "free-motion" quilting. More particularly, this invention is a device for holding and supporting a quilt on a small surface during the free-motion quilting operation as well as the process of using the device.

2. Description of the Prior Art

A "quilt" is defined in the dictionary as "a bedcover of two layers of cloth filled with down, cotton, wool, etc. and stitched together in lines or patterns to keep the filling in place". The act of "quilting" is defined in the same dictionary as "the act or process of making quilts", while a "quilting bee or party" is defined as "a social gathering of women at which, they work together sewing quilts". Taking all of these definitions together and adding a "free-arm" sewing machine for each participant produces the art of "free-motion" quilting. Free-motion quilting is the use of a free-arm portable sewing machine to stitch together the lines or patterns necessary to keep the filling in place in the quilt as opposed to quilting using a large industrial machine or doing it by hand. As quilts are large in size (i.e., bedcovers) they tend to use much floor space during the quilting operation. This floor space usage may become a problem at a quilting bee or in a quilting class where the participants may be forced to greatly separate themselves from each other to allow enough floor space between them to handle each partially constructed quilt.

Sewing machines come in various sizes and shapes. Generally speaking, a sewing machine has a mechanically driven reciprocating needle used for sewing and stitching. The reciprocating needle is positioned over a surface where the work piece of the quilt material is located and reciprocates to drive a needle, carrying thread, up and down through the work piece to develop lines of sewing and stitches to hold the various layers together. Some sewing machines occupy large work areas over which the work piece, such as a quilt can be totally unrolled and laid open for processing. However, over the years, the portable sewing machine has become a favorite in many homes because of its compactness and the ease in which it can be folded (usually in its own carrying case) and carried to someone's house.

The portable sewing machine is identified by its compactness and its "free-arm" which is an arm of the machine extending horizontally, from the needle-driving power source, above the base of the machine to create a space below the arm in which the work piece can be gathered when not in use. By using a portable sewing machine, it is possible for numerous persons to get together in a close, social gathering and work individually on their own work pieces, such as to make their own specific quilt, while conversing together exchanging ideas and gossip. While the portable sewing machine has remained compact over the years, the quilt has grown from a "regular" bed-size cover to a "queen-size" cover, to a "king-size" cover, to a "super-size" (called the "California" king-size) bed cover. Each of the quilts for these beds is very large and becomes a burden for many people who work on them at quilting bees.

The prior art has not paid much attention to this area of sewing. A patent was issued to Prather and Keim in 1905 (U.S. Pat. No. 804,501) disclosing a wire cloth holder and measuring device. A patent to E. T. Flemister was issued in 1909 (U.S. Pat. No. 923,255) showing a cloth bolt holder where a bolt of cloth is inserted into a loose arrangement of arcuate-shaped ribs to hold the bolt and allow some of it to be unwound for use and rewound for storage using the same ribs. In 1914 a patent was issued to J. A. Morrell (U.S. Pat. No. 1,104,697) disclosing a cotton lap roll truck including a pair of centralized support arms extending upward from support wheels to a roll tray wherein a roll of material is disposed for later use in various processes. In 1933 a patent was issued to J. G. Bentley et al (U.S. Pat. No. 1,930,076) that discloses a wider base and a roll tray separated into spaced-apart shorter roll trays. And, in 1944, a patent was issued to C. S. McCann (U.S. Des. Pat. No. 139,553) showing an ornamental design for a three-sided dolly. None of these patents concerned the need to make two rolls, in spaced-apart arrangement, to create a wrinkle-free zone therebetween for operation by a portable sewing machine to make stitching and sewing of quilts.

SUMMARY OF THE INVENTION

This invention is a device for compactly holding a broad-area quilt, during the sewing phase of the quilt-making operation, that includes a three-sided planar frame adapted to enter into close juxtaposition or nesting with the free arm of a common portable sewing machine. Spiral-shaped quilt-holding straps extend from each terminal end of each side member of the device for holding opposed, curled portions of the quilt apart from each other in a rolled-up configuration while another part of the quilt is being operated on by the sewing machine. This creates a wrinkle-free. planar work area of the quilt, preferably with height adjustment, attached to the underside of the frame, to support the frame for easy maneuvering over a small support surface, such as a card table top. This allows the sewing machine to be operated on a small portion of a quilt without interference from the rest of the quilt and allow the participants to be positioned close together for social interacting.

The frame is preferably made of wood and is rugged and light weight for easy handling by women and others. The adjustable rollers, under the frame, are necessary because various makes of portable sewing machines have their free-arm at different heights above their base and it is desired to have the center area or work area of the quilt supported on the frame at a level not too different from that of the work area of the machine's free-arm.

Accordingly, the main object of this invention is a quilt holder for use in free-motion quilting that confines the work area to a small space to allow more than one person to work in close harmony on their individual projects.

These and other objects of the invention will become more clear when one reads the following specification, taken together with the drawings that are attached hereto. The scope of protection sought by the inventor may be gleaned from a fair reading of the Claims that conclude this specification.

DESCRIPTION OF THE PREFERRED EMBODIMENT

Figure 1:
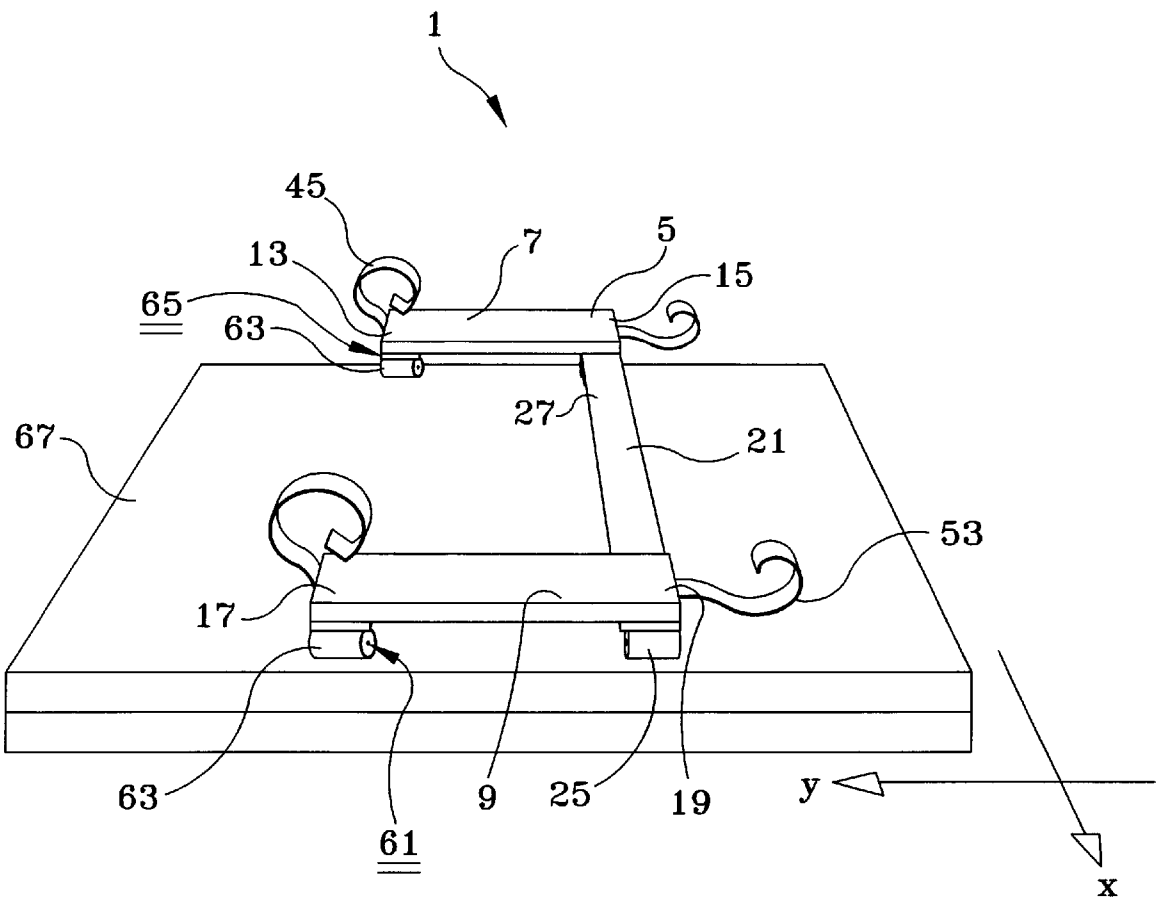
FIG. 1 is a perspective view of the preferred embodiment of the invention showing the frame positioned on a small supporting surface.

Turning now to the drawings wherein elements are identified by numbers and like elements are identified by like numbers throughout the 4 figures, the invention is depicted in FIGS. 1 through 4 and show a device 1 for compactly holding a large quilt 3 during the sewing phase of the quilt-making operation. Shown in FIG. 1 is a three-sided planar frame 5 having a pair of spaced-apart side members 7 and 9, each side member 7 and 9 terminated by ends 13 and 15 for (side member 7) and ends 17 and 19 (for side member 9). Preferably, side members 7 and 9 are made the same length and are straight. Side members 7 and 9 are attached to their respective terminal ends 13 and 17 to a single, common cross-member 21.

Figure 2:
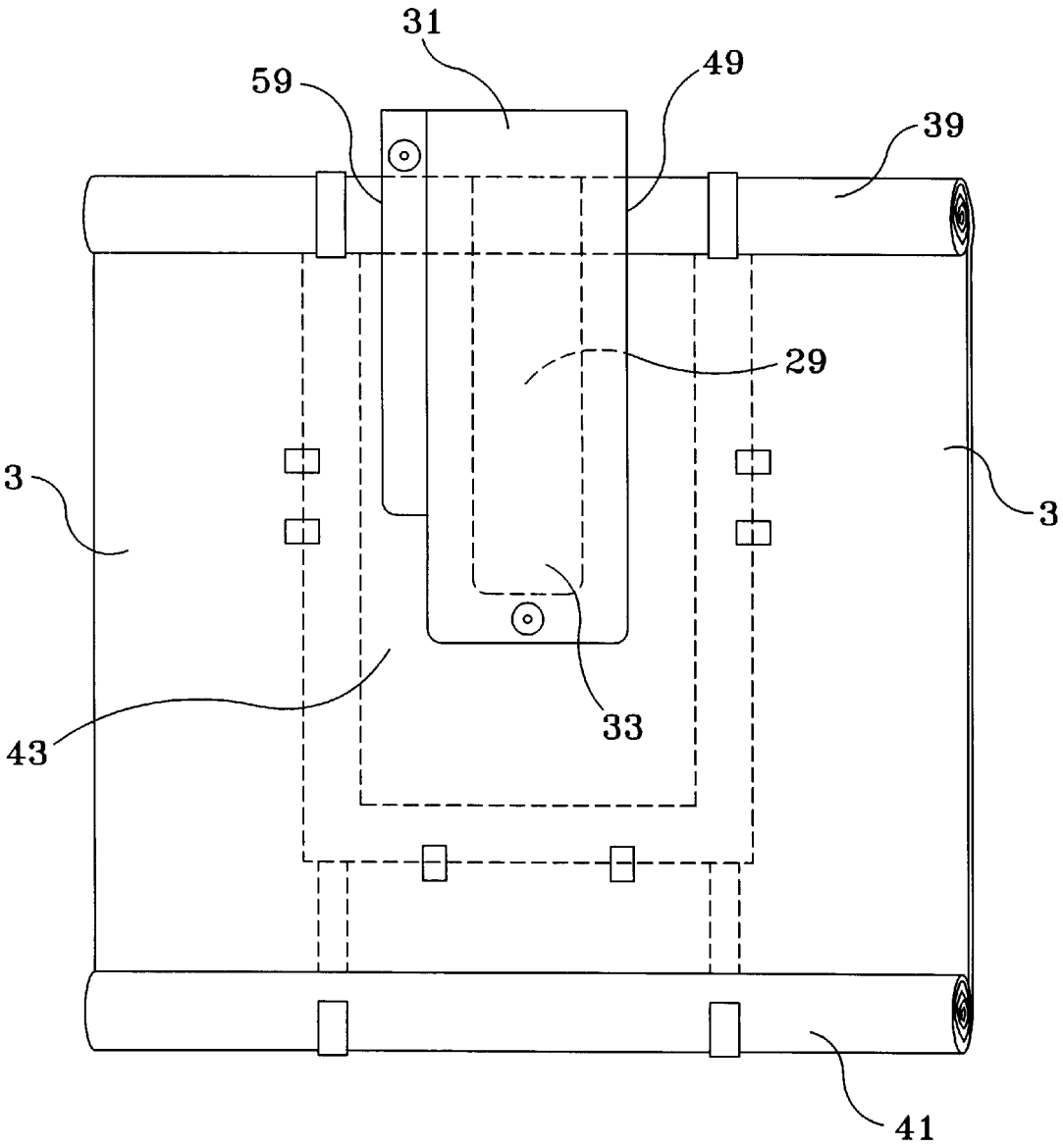
FIG. 2 is a top view of the invention placing a quilt under the needle of a sewing machine for stitching and sewing.
Figure 3:
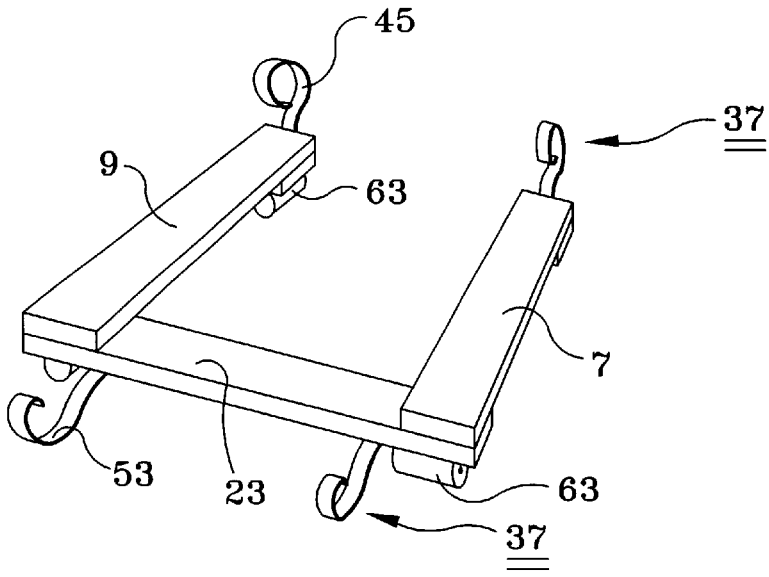
FIG. 3 is another perspective view of the preferred embodiment of the invention showing the roller means and more details on the quilt holding means; and, FIG. 4 is an illustrative view of a quilt being operated on by a sewing machine using the preferred embodiment of the invention with a cut-away portion showing the free arm under the quilt.
Figure 4:
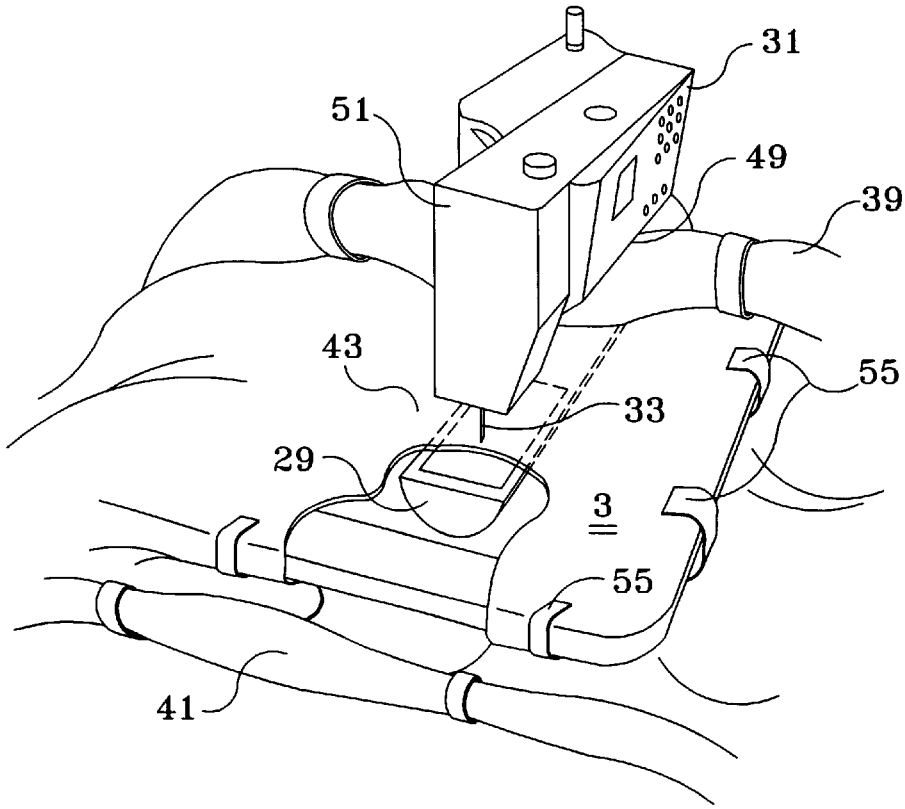

Cross-member 21 is preferably straight, and the connection between side members 7 and 9 with cross-member 21, preferably at the ends 25 and 27 of said cross-member, is preferably orthogonal and making frame 5 not only planar in overall design but also forming frame 5 into the three sides of a rectangle as shown in FIGS. 2 and 3. In this configuration, frame 5 is adapted to enter into close juxtaposition and nestle with the free arm 29 of a portable sewing machine 31 having a reciprocating stitching needle 33, positioned over free arm 29, as shown in FIGS. 2 and 4. Side members 7 and 9, as well as cross-member 21 are preferably made of wood, such as white pine, of a size such as 241 by 4" and 18 inches long, and are preferably glued and fastened together by screws or bolts (not shown) at their overlapping corner interconnections.

A quilt-holding means 37 extends from at least one terminal end, but preferably from each terminal end 13, 15 and 17, 19 of side members 7 and 9, or near their respective ends, for holding opposed, rolled or curled portions 39 and 41 of quilt 3 apart from each other in a rolled-up configuration, as shown in FIG. 2. Means 37 is curved in overall design and preferably made from segments of metal strap formed into an arcuate or spiral design, as shown in FIGS. 1 and 3, into which portions of quilt 3 may be placed or inserted and twisted into rolls 39 and 41 for temporary storage while a part of the quilt therebetween is formed into a wrinkle-free, planar work area 43 for being operated on by sewing machine 31 to create the stitching and sewing known as symbolizing a quilt as shown in FIGS. 2 and 4. Quilt holding means 37 is preferably made in two different configurations of spirals. The first type 45 is a full spiral that holds an end portion of quilt 3 in roll 39 above the top plane x-y of frame 5 and this roll is pushed to the rear 49 of the space above free arm 29 and below the top portion 51 of sewing machine 31. The second type 53 of means 37 in a more open or incomplete spiral and holds quilt 3 in roll 49 below plane x-y of frame 5 and usually in front of frame 5. In this manner, quilt roll 41 at the front of frame 5 allowing one or more portable clamps 55 to be used along the outside of side members 7 and 9, or along cross-member 21, to hold a portion of quilt 3 in flat, wrinkle-free work area 43 in the area of sewing machine needle 33 as shown in FIG. 4.

As shown in FIGS. 1 and 3, a roller means 61, including at least three wheels but preferably four wheels 63, are located preferably at each terminal end 13, 15, 17, and 19 of each side member 7 and 9. Roller means 61 can be virtually any commercially-available roller-mounting bracket or wheel-mounting bracket combination that is attachable, generally by screws (not shown) to the underside of frame 5. Preferably included in roller means 61 or provided separately therefrom is a height-adjustment means 65 to raise and lower frame 5 vis-a-vis above the support surface 67 for quilt 3, frame 5, sewing machine 31 and especially work area 43 such as the top of a common card table. Means 65 can be a common, commercially-available screw-thread driven extender placed between the underside of frame 5 and the wheels of roller means 61 or merely a shim, such as a magazine, a book, a piece of wood or the like placed under either sewing machine 31 or roller means 61. Support surface 67 may be provided by a common card table so that a plurality of them may be moved into a rather small floor area to provide a gathering place for participants in making various quilts.

It is important to be able to adjust the plane x-y of frame 5 to be more or less even with the height of the work surface of sewing machine free arm 29. As in many sewing machines, there are small teeth (not shown) under the top surface of the free arm that momentarily pop out of the surface and contact the quilt material to move it over the arm so that the sewing needle is always presented with new, unstitched areas of the quilt. If the difference in height between work area 43 of the quilt and the upper surface of free arm 29 is too great, the teeth may not engage the quilt in an efficient manner thereby allowing the quilt to slip and the stitching to overlap and damage the beauty of the quilt.

The method of using device 1, to retain separated portions of quilt 3 free of small working area 43, while area 43 has various portions thereof subject to the sewing operation using free arm 29 of portable sewing machine 31, comprises the steps of first providing a three-sided, compact frame 5 as earlier described and moving it by roller means 61 over support surface 67 into close juxtaposition or nesting with free arm 29 of portable sewing machine 31 as shown in FIGS. 2 and 4. Next, quilt-holding means 37 is provided and side portions of quilt 3 are placed in the spiral straps and twisted to develop rolled-up portions 39 and 41 apart from each other and, simultaneously create wrinkle-free, planar work area 43 therebetween for locating it under reciprocating sewing machine needle 35 and over free arm 29. Then, by moving frame 5 over support surface 67, sewing machine 31 and needle 35 are allowed to operate without interference from the rest of quilt 3. When necessary to obtain a new work area 43 of quilt 3, the operator unrolls portions of quilt 3 from one quilt holding means 37 and into another quilt holding means 37.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A device for compactly holding a quilt during the sewing phase of the quilt-making operation comprising:

a) a three-sided frame having spaced-apart side members, each said side member of terminal length and attached to a single, common cross-member, said frame adapted to enter into close juxtaposition with the free arm of a portable sewing machine;

b) quilt-holding means extending from at least one terminal end of each said side member for holding opposed, rolled portions of the quilt apart from each other to create a wrinkle-free, planar work area of the quilt therebetween; and, c) roller means for moving said frame over a small support surface to allow machine sewing of a small portion of a quilt without interference from the rest of the quilt.

2. The device of claim 1 wherein said side members are of the same length, said cross-member is straight, and the connection between said side members and said common cross-member is orthogonal to form three sides of a rectangle with the fourth side open.

3. The device of claim 1 wherein said frame is planar in overall design.

4. The device of claim 1 wherein said quilt-holding means includes resilient arcuate members adapted for holding a portion of the quilt in a rolled configuration.

5. The device of claim 1 wherein said quilt-holding means includes resilient arcuate members adapted for holding a portion of the quilt in a rolled-up, rolled-down configuration.

6. The device of claim 1 wherein said roller means includes at least three rollers attached to the underside of said frame to support said frame in its movement over a small surface.

7. The device of claim 1 wherein said roller means includes four rollers, one at said terminal end of each said side member, attached to the underside of said frame to support said frame in its movement over a small surface.

8. The device of claim 1 further including means to raise and lower said frame above the support surface.

9. The device of claim 1 further including at least two portable clamps to clamp the quilt against said side members on opposite sides of the free arm of the sewing machine.

10. A device for compactly supporting a small area of a quilt, in unwrinkled arrangement, during an operation wherein the small area of the quilt is the work area and is operably supported on top of the free, action arm of a portable sewing machine during the sewing phase of the quilt-making operation comprising:

a) a three-sided, compact frame having spaced-apart side members, each said side member of terminal length and attached to spaced-apart ends of a single, common cross-member, said frame adapted to be moved over the surface of a small support surface and to enter into close juxtaposition with the free arm of a portable sewing machine;

b) quilt-holding means extending from said terminal ends of each said side member for holding stored, rolled portions of the quilt apart from each other to create the wrinkle-free, planar work area of the quilt therebetween; and, c) roller means for moving said frame over a small surface to allow machine sewing of a small portion of a quilt without interference from the rest of the quilt and to unroll portions of the quilt and roll-up other portions of the quilt to provide new, unwrinkled, flat areas of the quilt to be subject to the quilt-making operation.

11. The device of claim 10 wherein said side members are straight and of the same length, said cross-member is straight, the connections between said side members and said common cross-member are orthogonal and said frame, including said side members and said cross-member, is planar in overall design.

12. The device of claim 10 wherein said quilt-holding means includes resilient arcuate members adapted for holding a portion of the quilt in a rolled configuration above the surface over which said frame is moveable to prevent interruption of the quilt-making operation.

13. The device of claim 10 wherein said quilt-holding means includes resilient arcuate members adapted for holding a portion of the quilt in a rolled-up configuration.

14. The device of claim 13 wherein said quilt-holding means includes at least two, spaced-apart arcuate members extending in opposite directions from the terminal ends of said side members, said arcuate members further including curled portions between which the quilt may be placed to twist the quilt into a rolled-up formation for temporary storage while another part of the quilt is being operated on by the sewing machine.

15. The device of claim 14 wherein said quilt-holding means include segments of metal strap formed into a spiral arrangement.

16. The device of claim 10 wherein said roller means includes at least three rollers attached to the underside of said side members and said frame to support said frame for movement over a small surface.

17. The device of claim 10 wherein said roller means includes four independent rollers, each rotatably attached to terminal end of each said side member, under of said frame to support said frame in its movement over a small surface.

18. The device of claim 10 further including at least two portable clamps to clamp the quilt against said side members on opposite sides of the free arm of the sewing machine.

19. The device of claim 10 further including means to raise and lower said frame above the work surface.

20. A method of temporarily retaining separate portions of a large area quilt free of a small working surface while sewing various portions of the quilt using the free arm of a portable sewing machine comprising the steps of:

a) providing a three-sided, compact frame having spaced-apart side members, each said side member of terminal length and attached to spaced-apart ends of a single, common cross-member, said frame adapted to be moved over the surface of a small support surface and to enter into close juxtaposition with the free arm of a portable sewing machine;

b) providing quilt-holding means extending from said terminal ends of each said side member for holding stored, resilient arcuate members adapted for holding a portion of the quilt in a rolled configuration;

c) inserting a portion of the quilt in said quilt-holding means to hold it in a rolled-up configuration and hold said rolled-up portions of the quilt apart from each other to create the wrinkle-free, planar work area of the quilt therebetween; and, d) providing roller means for moving said frame over a small surface to allow a sewing machine having a free arm wherein the needle is located to operate without interference from the rest of the quilt and to unroll portions of the quilt and roll-up other portions of the quilt in said quilt-holding means to provide new, unwrinkled, flat areas of the quilt to be subject to the quilt-making operation.

* * * * *

UNITED STATES PATENT AND TRADEMARK OFFICE

CERTIFICATE OF CORRECTION

PATENT NO. : 6,688,247 B1
DATED : February 10, 2004
INVENTOR(S) : Lawerence Henry Danielson It is certified that error appears in the above-identified patent and that said Letters Patent is hereby corrected as shown below:

Title page,
Item [57], ABSTRACT,
Please correct the Abstract to read as follows:

--

A device for compactly holding a large quilt during the sewing phase of the quilt-making operation including a three-sided frame having spaced-apart side members, each the side member of terminal length and attached to a single, common cross-member, the frame adapted to enter into close juxtaposition or nesting arrangement with the free arm of a portable sewing machine, a quilt-holding fitting extending from each terminal end of each side member for holding opposed, curled portions of the quilt apart from each other to create a wrinkle-free, planar work area of the quilt therebetween, and a plurality of wheels for moving the frame over a small support surface, such as a card table, to allow machine sewing of a small portion of a quilt without interference from the rest of the quilt. --

Column 3,
Line 33, to read as follows: -- made of wood, such as white pine, of a size such as 2" by --

Signed and Sealed this

Twenty-seventh Day of April, 2004

JON W. DUDAS
*Acting Director of the United States Patent and Trademark Office*